US006354796B1

(12) United States Patent
Morando

(10) Patent No.: US 6,354,796 B1
(45) Date of Patent: Mar. 12, 2002

(54) PUMP FOR MOVING METAL IN A BATH OF MOLTEN METAL

(75) Inventor: Jorge Morando, Cadiz, KY (US)

(73) Assignee: Alphatech, Inc., Cadiz, KY (US)

( * ) Notice: Subject to any disclaimer, the term of this patent is extended or adjusted under 35 U.S.C. 154(b) by 0 days.

(21) Appl. No.: 09/398,271

(22) Filed: Sep. 20, 1999

Related U.S. Application Data

(62) Division of application No. 09/130,937, filed on Aug. 7, 1998.

(51) Int. Cl.[7] ..... F04D 29/70

(52) U.S. Cl. ..... 415/121.2; 415/200; 415/206

(58) Field of Search ..... 415/121.2, 169.1, 415/88, 206, 200; 416/247 R, 241 B, 146 R, 185, 186 R, 181, 231 A, 231 R; 266/233, 239; 248/676, 672

(56) References Cited

U.S. PATENT DOCUMENTS 2,468,704 A * 4/1949 Pippin ..... 415/200
2,808,782 A * 10/1957 Thompson et al. ..... 415/121.1
3,255,702 A * 6/1966 Gehrm ..... 415/200
3,291,473 A * 12/1966 Sweeney et al. ..... 415/208.1
3,612,715 A * 10/1971 Yedidiah ..... 415/131
3,724,831 A * 4/1973 Huffman ..... 415/121.2
3,836,280 A * 9/1974 Koch ..... 415/175
4,940,384 A * 7/1990 Amra et al. ..... 415/121.1
5,088,893 A * 2/1992 Gilbert et al. ..... 415/200
5,181,828 A * 1/1993 Gilbert et al. ..... 415/200
5,203,681 A * 4/1993 Cooper ..... 417/424.1
5,238,363 A * 8/1993 Thielke et al. ..... 415/121.2
5,676,520 A * 10/1997 Thut ..... 415/121.3

* cited by examiner

*Primary Examiner*—Edward K. Look
*Assistant Examiner*—Ninh Nguyen

(57) ABSTRACT

Apparatus for moving a stream of molten metal in a bath of molten metal, includes a pump disposed in the met. The pump has a lower inlet opening with a strainer and a slinger rib to prevent the entry of debris that exceeds a predetermined diameter from passing through the pump.

15 Claims, 9 Drawing Sheets

PUMP FOR MOVING METAL IN A BATH OF MOLTEN METAL

This application is a division of application Ser. No. 09/130937, filed Aug. 7, 1998, pending.

BACKGROUND OF THE INVENTION

This invention is related to mechanical pumps for moving or pumping metal such as aluminum or zinc in a bath of molten metal, and more particularly to such a pump in which a motor supported above the bath drives a vertical stainless steel shaft. The lower end of the shaft drives the impeller to create a stream of molten metal. A ceramic sleeve shields the stainless steel shaft to protect it from the corrosive effects of the heated molten metal, as well as forming a loose fit with the shaft to accommodate differences in the thermal expansion characteristics between the ceramic and the stainless steel.

Mechanical power driven pumps for moving metal in a bath of molten metal conventionally have a relatively short life because of the destructive effects of the molten metal on the pump components. If the pump shaft connecting the motor to an impeller is formed of any steel to provide sufficient torque to move the impeller in the molten metal, the steel has a short life because it is chemically attacked by the molten metal. If the steel shaft is shielded by a protective coating of a ceramic material, then the different thermal expansion characteristics of the steel and the ceramic causes the ceramic to shatter in a relatively short time.

A shaft made of graphite alone will burn at the metal surface. A shaft made of ceramic alone does not have sufficient tensile, torque or impact strength to overcome the stresses normally encountered when pumping molten metal.

A pump housing submerged in molten metal and made of graphite or ceramic material to withstand the heat, tends to rise in the metal bath because the ceramic has a lower density than the metal. In order to prevent the pump housing from rising in the metal, it is desirable to mount a series of vertical legs between the pump housing and an overhead supporting structure. In addition the legs (or posts as they are also called) should be strong enough to overcome the tensile stresses created during installation and subsequent removal of the pump in the molten metal bath. Such legs experience problems similar to that of an unshielded pumping shaft, that is, if they are made of an uncoated steel they have a short life because the steel is attacked by the molten metal. If they are made entirely of graphite, the legs will bum at the metal interface. If a leg is made entirely of a ceramic material having good heat resistant characteristics, it has insufficient tensile strength to ensure a long life.

SUMMARY OF THE INVENTION

The broad purpose of the present invention is to provide a shielded stainless steel driving shaft for a centrifugal impeller-type pump immersed in a molten metal bath.

Another object of the invention is to provide an improved stainless steel leg (post) for supporting and preventing the pump housing from rising in the molten metal.

Still another object of the invention is to provide an improved static inlet filter configuration for an impeller pump immersed in a molten metal bath.

Still another object of the invention is to provide a ceramic shield surrounding a graphite leg and forming an inert gas chamber around the leg. An inert gas is delivered to the gas chamber to provide an oxygen-free environment around those graphite components of the leg that may tend to burn at the temperatures of the surface of the molten metal bath.

Still another object of the invention is to provide a dynamic filter for the inlet opening of the impeller of a pump mounted in a molten metal bath. The filter rotates with the impeller without interfering with the pumping vanes. Slinger ribs provided on the dynamic filter deflect debris attempting to enter the strainer apertures to prevent their passage into the pump housing.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
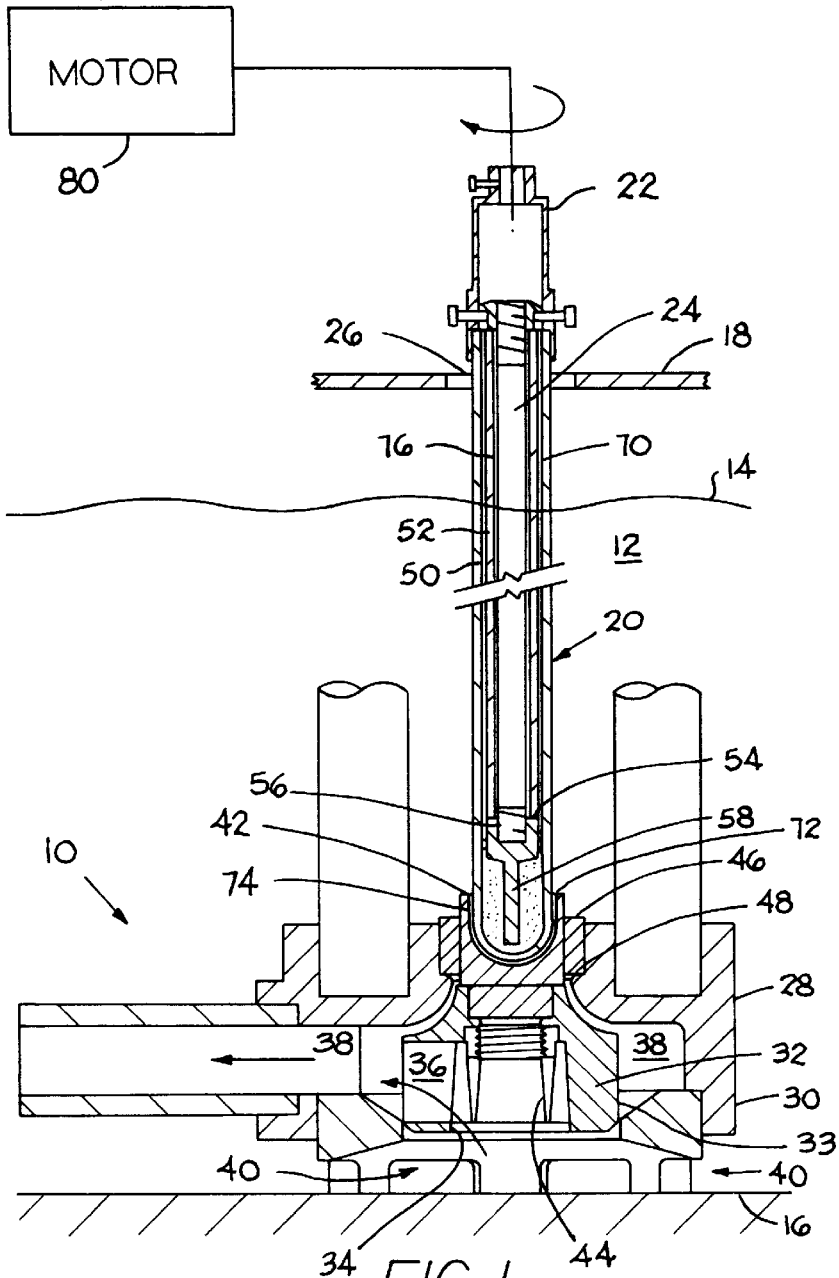
FIG. 1 is a longitudinal sectional view of an impeller pump immersed in a bath of molten metal and illustrating the preferred embodiment of the invention.

Referring to the drawings, FIG. 1 illustrates a preferred impeller pump 10 having a lower pumping end disposed in a bath of molten metal 12 such as aluminum. The bath has a top metal level 14. Typically the bath operates at a temperature not in excess of 1800° F. The bath is contained by a pot having a floor 16. An electrically driven motor 80 is supported in any suitable location above the pump cover plate 18, and is connected by a coupling 22 to a stainless steel pumping or driving shaft 24. The shaft is supported in an opening 26 in the pump cover plate. The shaft has a sufficient length that the upper end is supported above cover plate 18 and its lower end is disposed in the bath of molten metal 12.

A pump housing assembly 28 includes a housing 30 and a vane-type pumping member 32 disposed in the housing. The shaft is drivingly connected to the pumping member to rotate it in the housing in order to produce a stream of molten metal that enters the housing adjacent the floor of the pot through an inlet opening 34, into a pumping chamber 36 and toward an outlet opening 38 in the direction of arrows 40.

The pumping member includes a ceramic impeller 33 which carries pumping vanes 44. Bearing means 46 carried in a shoulder 48 of the housing 30 engage a ceramic end driver 42 cemented to a vertical outer tubular ceramic shield 50. The lower end of the end driver 42 is closed off and fits into pumping member 32. The upper end of the shield extends upwardly through cover plate 18. End driver 42, after cementing, forms a single integral part of shaft assembly 20 together with shield 50, tubular spacer shield 52, steel driving shaft 24 and tongue 58.

Inner ceramic tubular shield 52 is cemented to the inside of the outer shield 50. The upper end of the inner shield is flush with the upper end of the outer shield. The inner tubular shield is shorter than the outer shield to form an annular shoulder 54.

The lower end of the drive shaft 24 is threaded at 56 as illustrated in FIG. 1. The threaded end 56 extends below shoulder 54. A stainless steel tongue 58 is threadably mounted on threaded end 56 and seated on shoulder 54 in a manner that will be described.

Figure 2:
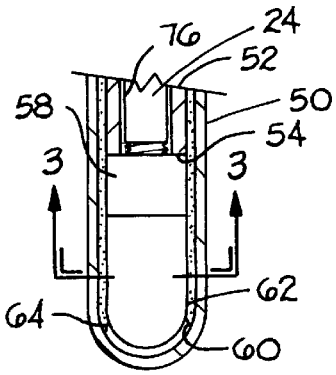
FIG. 2 is an enlarged view of the tongue carried on the lower end of the driving shaft for rotating the impeller.
Figure 3:
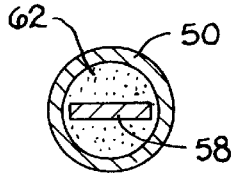
FIG. 3 is a view as seen along lines 3—3 of FIG. 2.

Referring to FIG. 2, the inside bottom of the outer shield forms a chamber 60. Tongue 58 is disposed in the chamber. Cement 62 is disposed in the chamber and has a socket 64 generally corresponding to the configuration of the tongue but slightly larger to provide for a clearance between the tongue and the socket to allow for thermal expansion differences.

As can be seen in FIG. 2, the bore 76 of the spacer shield 52 is larger than the diameter of the shaft 24 to provide a clearance which permits the shaft to expand in response to heat without creating an expansion tensile stress on the spacer shield 52. Similarly, the tongue has a clearance that permits it to expand in response to heat without creating an expansion interference stress with the cement. The clearance between the driving structure (shaft) and the socket is formed by the steps of forming the outer tubular shield with a lower blind end, disposing a cement in the blind end of the outer tubular shield to form a socket having a configuration similar to but larger than that of the driving structure; disposing a wax that turns to a gas when exposed to the heat in a bath of molten metal, in the socket; disposing the driving structure in the wax; telescopically inserting the inner tubular shield and the outer tubular shield to engage the driving structure, and cementing the inner tubular shield to the outer tubular shield to form a unitary tubular shield around the shaft.

Referring to FIG. 1, coupling 22 forms the connection between the motor shaft and the shield assembly 20 that rotates pumping member 32 with impeller vanes 44. torque from the shaft is transmitted through the tongue to the body of cement to outer tubular shield 50 to the end driver 42, that is through the lower end of the shaft to the impeller. The shaft has a sufficient torque characteristic for driving the impeller in molten metal.

The inner spacer shield is located to form an annular air chamber 76 between the shaft and the inner shield along its full length. The air chamber has a size chosen to permit the stainless steel shaft to fully expand in the bath of molten metal without applying any expansion pressure on the ceramic shield. The shaft is then fully shielded by heat-resistant and molten metal resistant ceramic.

Figure 4:
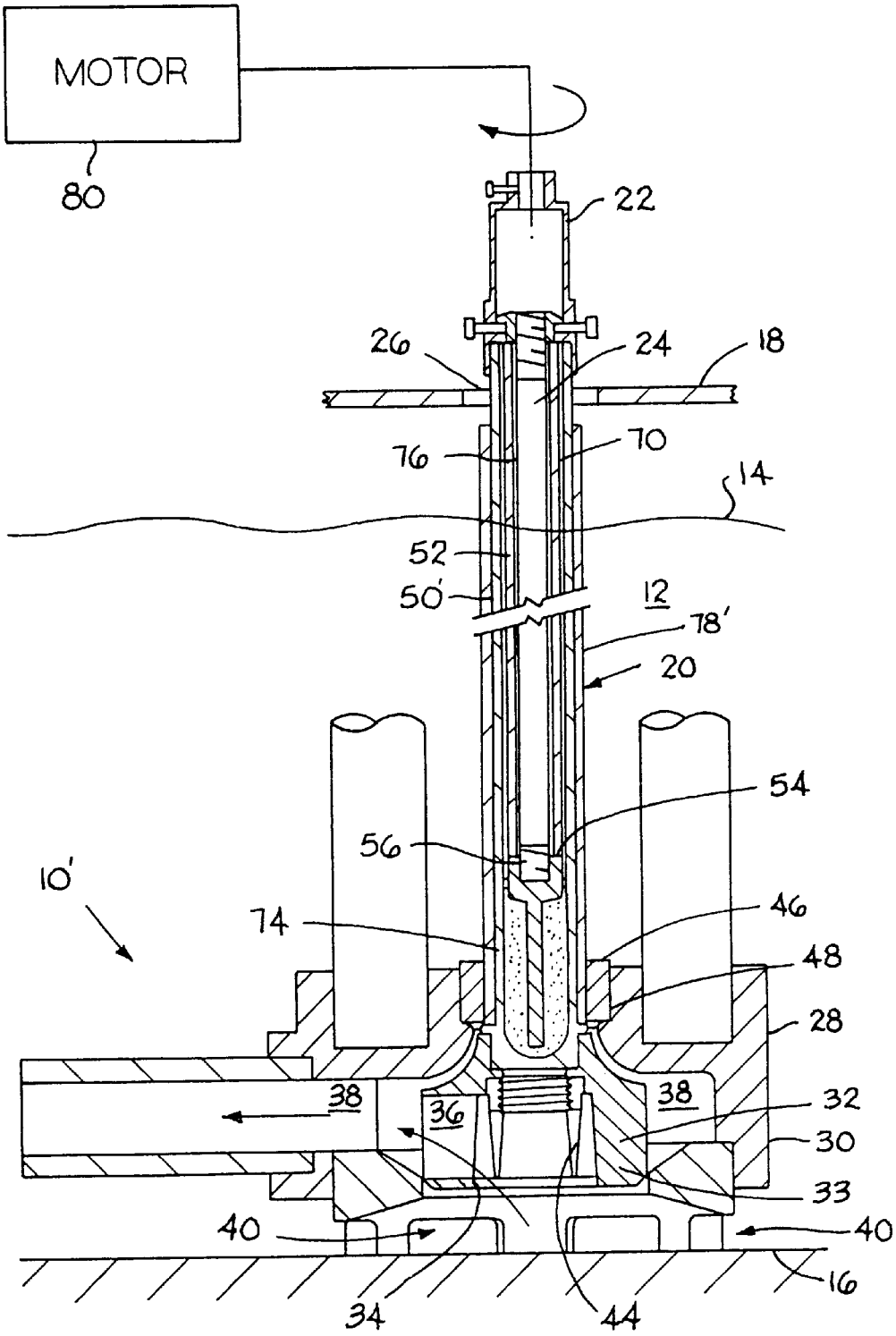
FIG. 4 is a longitudinal sectional view of an impeller pump immersed in a bath of molten metal and illustrating a graphite quill shaft design with an external ceramic shield protection.

FIG. 4 illustrates a modified impeller pump 10'.

Bearing means 46 carried in a shoulder 48 of the housing 30 engage an inner graphite sleeve-like shield 50'. The lower end of shield 50' is closed off and fits into pumping member 32. The upper end of shield 50' extends upwardly through cover plate 18. Inner shield 50' is cemented to a protective ceramic sleeve 78' to form a single integral part of shaft assembly 20 together with, spacer shield 52, steel driving shaft 24 and tongue 58.

Figure 5:
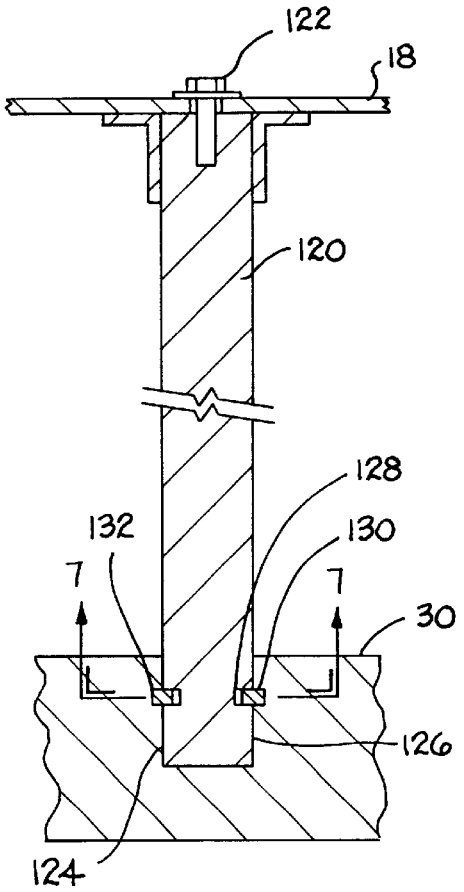
FIG. 5 is a view of an unshielded leg used for connecting a pump housing to an overhead structure.
Figure 6:
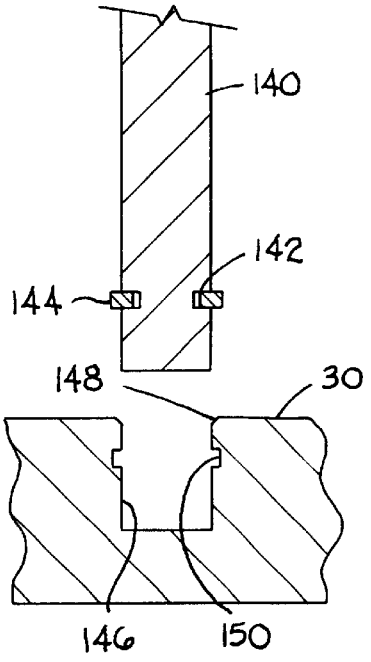
FIG. 6 is a view illustrating a split ring employed for connecting the lower end of the leg to the pump housing.
Figure 7:
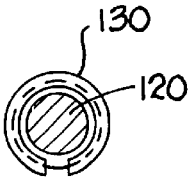
FIG. 7 is an enlarged view as seen along lines 7—7 of FIG. 5.

FIGS. 5–6 show various forms of an unshielded vertical leg that can be mounted between the pump housing 30 and cover plate 18 in order to lock the pump legs to the pump housing without the use of load-carrying cements, eliminating the need for large clearances between the legs and post sockets. Graphite cement is used only as a sealant to prevent molten metal penetration.

Graphite leg 120 has an upper end fastened to the cover plate by a threaded fastener 122. The lower end of the leg is received in a cylindrical socket 124 in the pump housing. The leg's lower end has an annular enlargement 126 which is bottomed in the socket. The leg has an annular groove 128 above the enlargement for receiving a close fitting split ring 130. The socket also has an annular groove 132 for receiving the split ring.

In this embodiment of the invention, the lower end of the leg is inserted into the socket by squeezing the split ring into groove 128. Once the split ring is disposed in the socket, the shaft is pushed down until the split ring snaps into groove 132 thereby being disposed in both the groove in the leg and the groove in the socket, locking the leg in position.

FIG. 6 illustrates another embodiment of the invention in which a vertical leg 140 has an annular groove 142 for receiving a close fitting split ring 144. The pump housing 30 has a socket 146. The upper edge of the socket is chamfered as at 148 in such a manner that as the leg is inserted into the socket, the chamfered edge squeeze the split ring into the groove 142. The leg is moved further into the socket until the split ring is partially expanded into the annular groove 150 in the socket. The split ring is disposed in both the socket of the leg and the groove of the socket thereby locking the leg to the housing.

Figure 8:
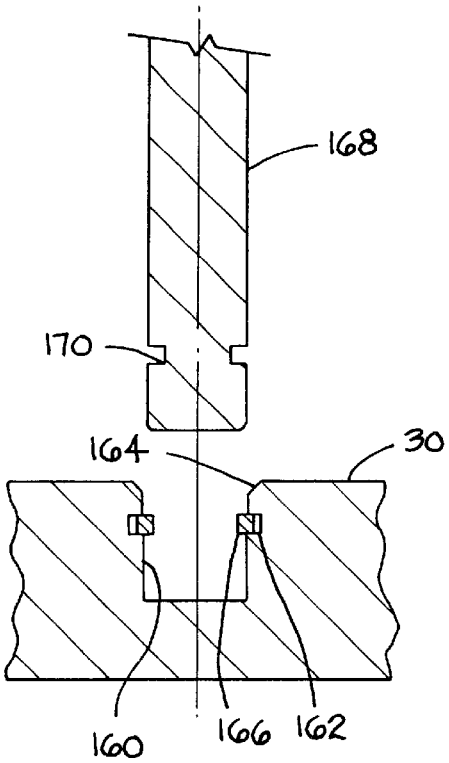
FIG. 8 is a view of another arrangement for connecting the support leg to the pump housing.

In FIG. 8, housing 30 has a generally cylindrical socket with a radial groove 162. The upper wall of the groove is adjacent a chamfered lip 164. Split ring 166 is placed in groove 162. When leg 168 is pushed into socket 160, ring 166 will expand, then snap into groove 170.

Figure 8A:
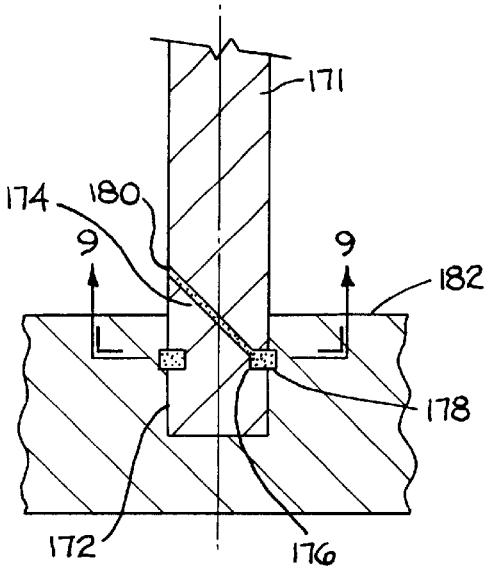
FIG. 8A is a view of a graphite leg for supporting the pump housing, utilizing graphite cement for connecting the lower end of the leg to the pump housing.
Figure 9:
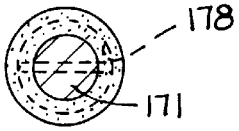
FIG. 9 is a view as seen along lines 9—9 of FIG. 8A.

FIGS. 8A and 9 illustrate another version of a leg-housing locking device. Leg 171 has a groove 178 connected by means of passage 174 to an opening 180 located above the upper surface of housing 182. Housing 182 has a socket 172 with an annular groove 176. After leg 171 is inserted in housing socket 172, graphite cement is injected under pressure in opening 180 and via passage 174 fills the cavity generated by grooves 176 and 178 in the housing and leg respectively, thus, preventing, after hardening, any axial displacement of the leg with respect to the housing.

Figure 10:
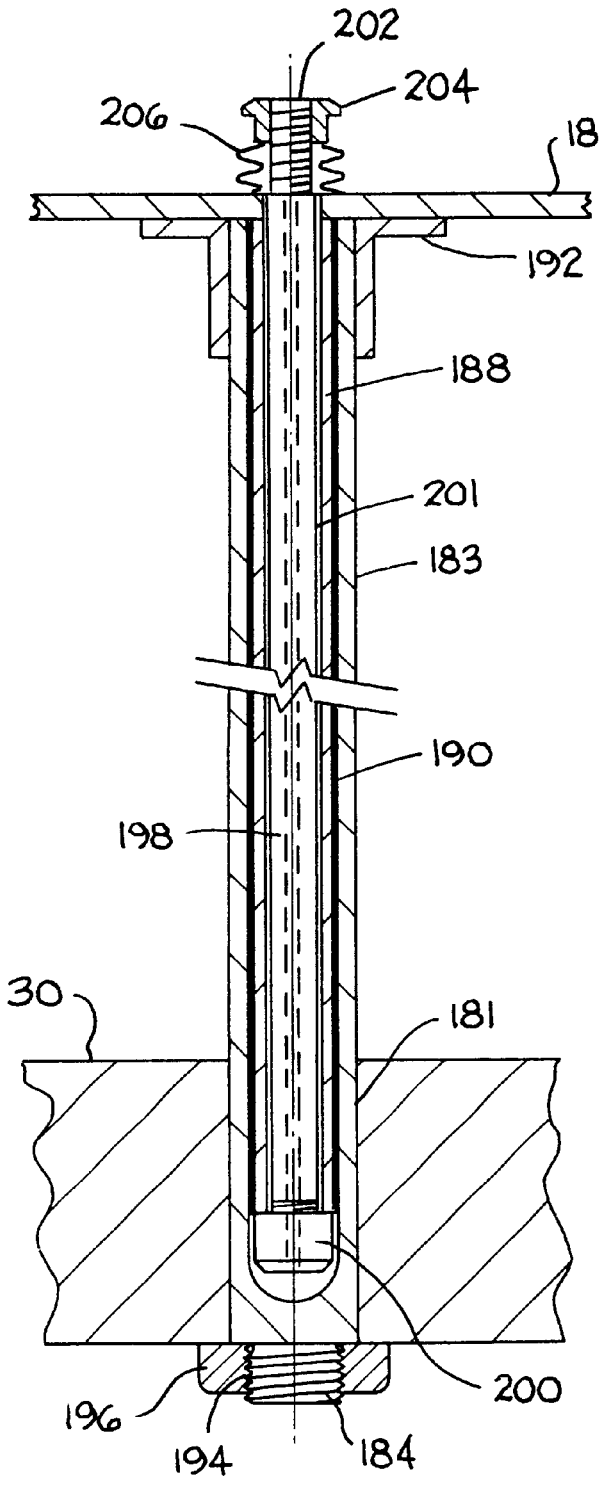
FIG. 10 is a view of a quill-shaft, ceramic support leg for the pump housing.

FIG. 10 illustrates a shielded upright quill leg for supporting pump housing 30 beneath a cover plate 18. An opening 181 is formed in housing 30. An outer ceramic tubular shield 183 is formed with a length sufficient so that its lower blind end extends below the inside surface of the wall of housing 30. The upper end abuts cover plate 18.

An inner ceramic tubular shield 188 is disposed inside the outer shield and cemented along the length and around the inner shield in the area 190 (indicated by the heavier line). The lower end of the inner shield extends above the bottom of the outer shield. The upper end of the outer shield is located by an annular mounting member 192 that is attached to the cover plate. The lower end of the outer shield is threaded at 194 to receive a locking nut 196 which is screwed up to abut the inside surface of the housing.

A stainless steel leg 198 is disposed in the inner shield. The lower end of the stainless steel leg has a radial enlargement 200 which has a diameter less than the inner diameter of the outer shield but greater than the inner diameter of the inner shield so that it abuts the lower edge of the inner shield. Leg 198 is located so as to form an annular chamber 201 between the leg and the inner shield to permit the leg to thermally expand when it is disposed in the molten metal bath, without imposing an expansion stress on the shields.

The upper end of the leg is threaded at 202 for receiving a locking nut 204 and bevel washer 206 in order to lock the leg in position when it has been properly located within the ceramic shield.

Figure 11:
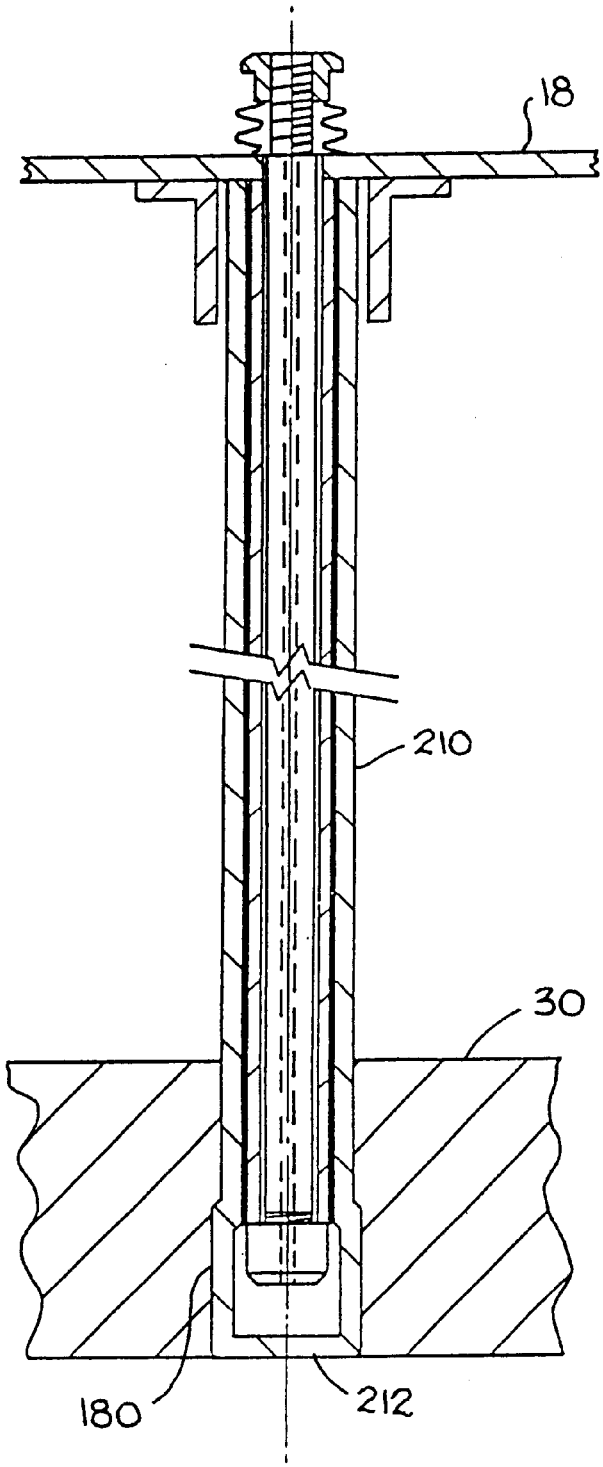
FIG. 11 is a view of another form of a quill-shaft, ceramic support leg for the pump housing.

FIG. 11 illustrates a slightly modified version of the shielded leg of FIG. 10. In this case a tubular shield 210 comprises inner and outer ceramic shields similar to those illustrated in FIG. 10, and an internal stainless steel leg. The lower end of the outer shield has an enlargement 212 sequestered inside a corresponding similar enlargement in the housing instead of using nut 196 with the threaded configuration.

Figure 11A:
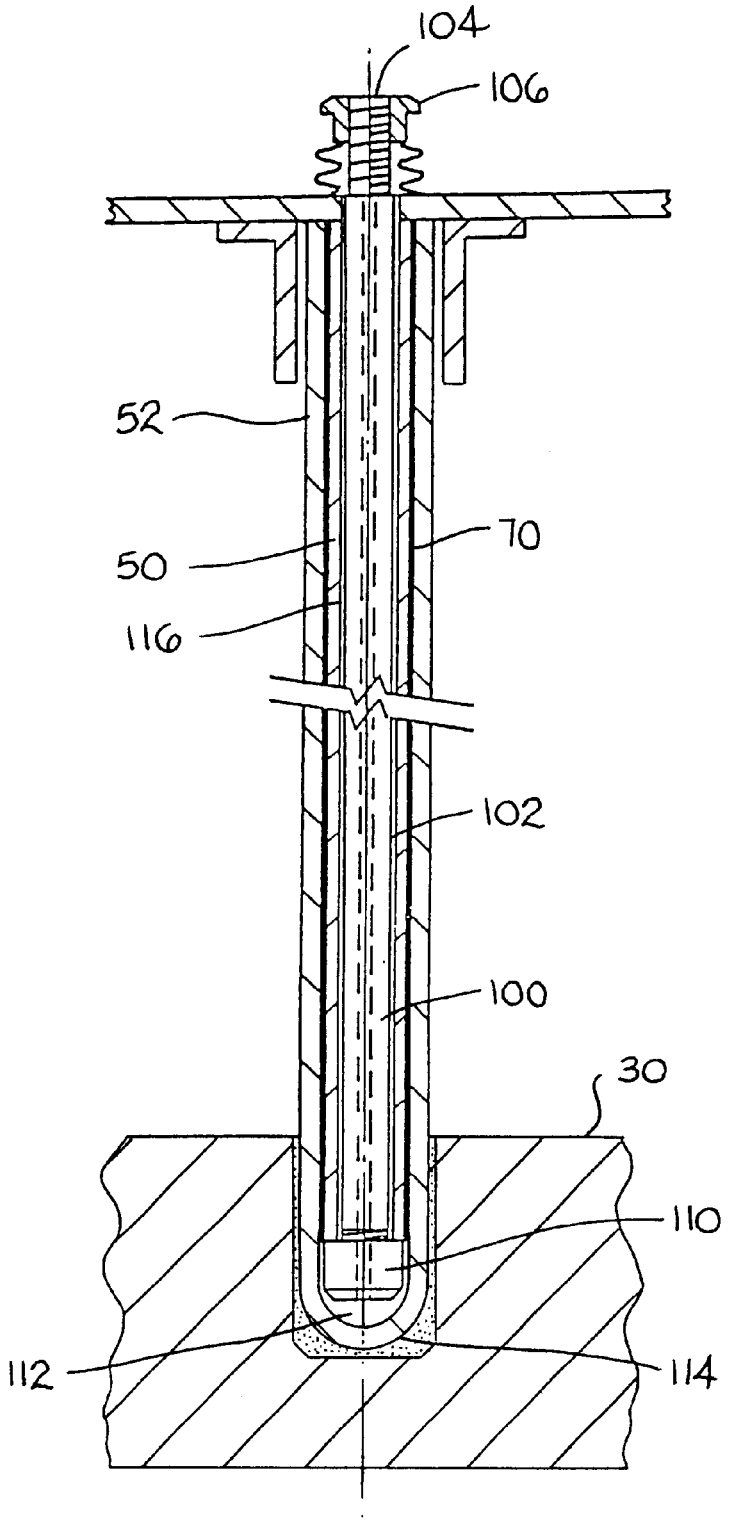
FIG. 11A is a view of another form of a quill-shaft ceramic or graphite support leg for the pump housing.

FIG. 11A illustrates a quill leg that is identical to that of FIG. 11 except that it has been cemented to pump housing 30 in accordance with common post-cementing procedures known by a person skilled in the art.

Figure 12:
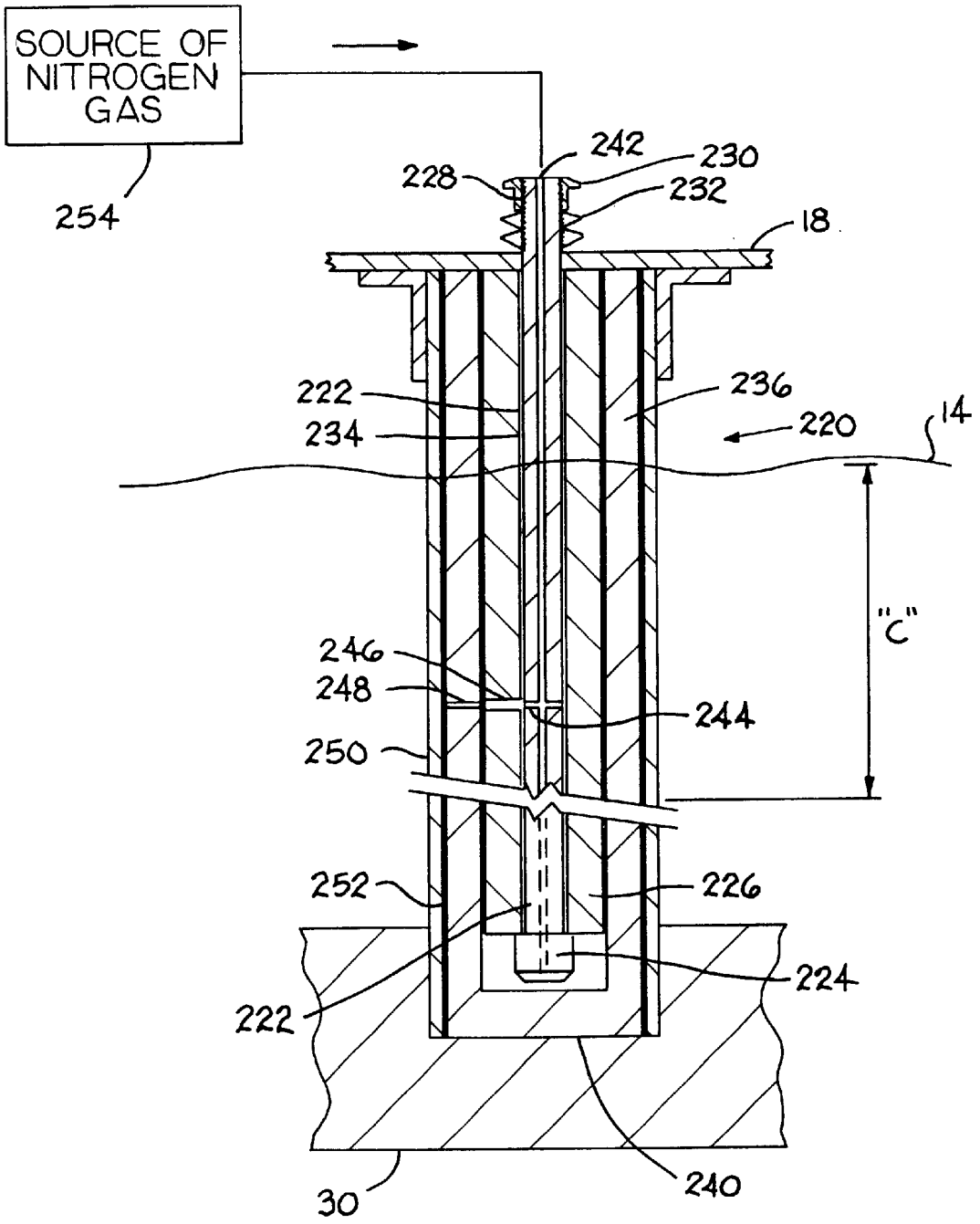
FIG. 12 is an enlarged fragmentary view of a graphite inert quill-shaft support leg for the pump, having an oxygen-free chamber to eliminate oxidation of the graphite components.

FIG. 12 illustrates another version of a shielded leg 220 for supporting pump housing 30 beneath cover plate 18. This particular design utilizes graphite components in combination with a ceramic outer sleeve to protect the graphite outer shield. Although the graphite components of the leg are protected by the heat resistant ceramic shield, in some cases the air chamber between them or air leakage provides sufficient oxygen to allow the support leg components to bum.

In this case, a stainless steel leg 222 has an enlargement 224 carried at its lower end mounted within an inner graphite tubular shield 226. The enlargement is seated against the lower end of the inner shield. The upper end of the leg is threaded at 228 to engage a fastening nut 230 and bevel washers 232 in such a manner that by tightening on nut 230, enlargement 224 firmly seats graphite shield 226 in position against the bottom of the cover plate to form a gas chamber 234 around leg 222.

An intermediate tubular graphite shield 236 telescopically receives the inner shield and has its internal surface cemented to the inner shield.

Leg 222 has a longitudinal gas passage 242 that extends from its upper end down to its lower end and also radially out through an opening 244 into chamber 234.

The inner shield, in turn, has a small passage 246 which communicates with a passage 248 in shield 236.

An outer ceramic tubular shield 250 encloses both of the graphite shields and has an internal annular chamber 252 in communication with passage 248. Chamber 252 is filled with molten metal resistant cement. A source of nitrogen 254 is connected to passage 242 to form an oxygen-free atmosphere around the leg as well as an oxygen-free atmosphere along and around the graphite shields exposed to the metal level to prevent the graphite shields from burning.

Figure 13:
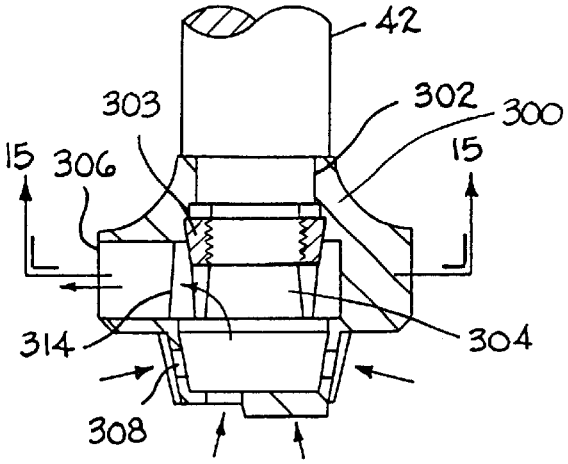
FIG. 13 is a sectional view of a dynamic strainer for the pump.
Figure 14:
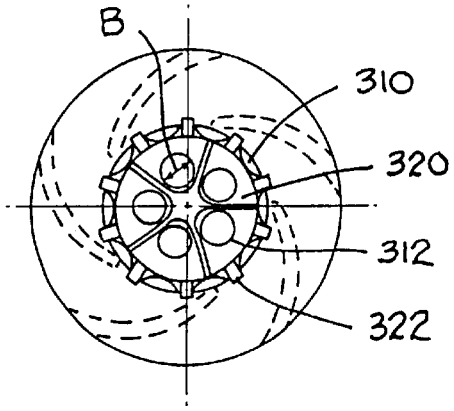
FIG. 14 is a bottom view of FIG. 13.
Figure 15:
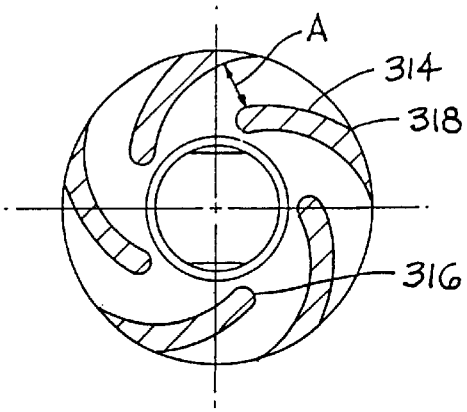
FIG. 15 is an enlarged view of the internal pumping vanes of the embodiment of FIG. 13.

FIGS. 13–15 illustrate a combination dynamic filter and pumping vane member 300 that may be substituted for the pumping member 32 illustrated in FIG. 1. Pumping vane member 300 has an opening 302 for receiving the lower threaded end of pumping shaft 42. A nut 303 attaches the body to the pumping member 300. Pumping member 300 thus rotates with driving shaft 24.

The pumping member has an internal chamber 304 with outlet opening means 306 and an apertured bottom strainer plate 308. The strainer plate has an annular outer series of openings 310 and an inner series of openings 312. The inner series of openings are in a bottom horizontal portion of the strainer plate while the outer inlet openings are in a frustoconical wall.

Referring to FIG. 15, the pumping member has a series of pumping vanes 314 which are curved to form openings each having a width A in such a manner that as the pumping member is rotated, the pumping vanes draw the liquid metal through the inlet openings and then push the liquid metal out through the outlet opening means 306. Strainer openings 310 and 312 have a maximum diameter B that is smaller than the larger openings A between the vanes. Thus the strainer openings prevent debris having a size larger than strainer openings B from entering into the pumping chamber thereby preventing any clogging of the vane openings.

A series of inner linear radial slinger bars 320 and outer radial slinger bars 322 are mounted on the strainer plate between adjacent strainer openings to strike any relatively large debris attempting to enter the strainer openings before they reach the vane openings. The slinger vanes strike the debris thereby permitting the pump to be located closely adjacent the bottom of the molten metal pot thereby permitting a stream of inlet liquid metal to be generated at a lower level in the pot.

Thus, it is to be understood that several variations have been described of an improved impeller-type pump useful in molten metal baths as well as several variations of shielded legs for supporting the pump in the molten metal bath.

Having described my invention, I claim:

1. Apparatus for moving a stream of molten metal in a bath of molten metal comprising:

a pumping member adapted to be disposed in a bath of heated molten metal and to move a stream of molten metal as the pumping member is driven in a path of pumping motion;

a power device adapted to be supported above the bath of molten metal and to be actuated in a powered motion;

means for connecting the power device to the pumping member to move the pumping member in said path of pumping motion;

a pump housing having a pumping chamber and an inlet opening, the pumping member being disposed in the pump housing, the inlet opening being adapted for receiving molten metal into said pumping chamber;

the pumping member having a strainer plate having apertures for receiving molten metal into the pumping chamber as the pumping member is being rotated about an axis of rotation; and a slinger rib mounted on the strainer plate adjacent the apertures and upstream thereof so as to strike debris carried into the stream toward the apertures, in a direction away from said inlet opening as the pumping member is being rotated.

2. Apparatus as defined in claim 1, in which the strainer plate has a convex configuration including a planar bottom bounded by a frusto-conical side wall, and the planar bottom has said apertures, and including other apertures in the frusto-conical side wall.

3. Apparatus as defined in claim 2, in which the slinger rib is mounted between the apertures in the slinger bottom, and including another slinger rib mounted on the frusto-conical wall between the apertures therein.

4. An apparatus for moving a stream of molten metal, comprising:

a pumping member;

a housing at least partially enclosing the pumping member;

a power device;

a shaft connecting the power device and the pumping member, said shaft having an elongated drive element and an elongated shield assembly, the shield assembly surrounding and forming a space between the drive element and the shield assembly sufficient to permit thermal expansion of the drive element;

the shield assembly; comprising:

an outer tubular shield connected to the pumping member; an inner tubular shield telescopically disposed in the outer shield; said inner tubular shield surrounding said drive element; an elongated graphite member disposed between said inner and outer tubular shields; and further including a tongue (58) carried on the lower end of the drive element (24) and secured to the pumping member; and cement disposed in the outer shield to provide a socket accommodating said tongue, the tongue being disposed in said socket but having a clearance therebetween to accommodate the relative thermal expansion characteristics of said tongue, but permitting the tongue to be rotated to engage the socket to rotate the pumping member.

5. A support as defined in claim 4 in which the housing is formed of a heat resistant ceramic.

6. An elongated support suited for positioning a pump in a bath of molten metal, comprising:

a housing of a material that is resistant to the heat of the molten metal, said housing having an internal chamber;

means for introducing an inert gas into said internal chamber;

a structure, including a graphite shield, disposed in the internal chamber; and said structure having a tendency to be combustible in the presence of oxygen and non-combustible in the presence of an inert gas at such times as the housing is at least partially disposed in the bath of molten metal.

7. Apparatus for moving a stream of molten metal in a bath of molten metal, comprising:

a pumping member adapted to be disposed in a bath of heated molten metal and to move a stream of molten metal as the pumping member is driven in a path of pumping motion;

a power device adapted to be supported above the bath of molten metal and to be actuated in a powered motion;

means for connecting the power device to the pumping member to move the pumping member in said path of pumping motion;

a pump housing having a pumping chamber and a bottom inlet opening, the pumping member being disposed in the pump housing, the bottom inlet opening being adapted for receiving molten metal into said pumping chamber;

the pumping member having a strainer plate having apertures for receiving molten metal into the pumping chamber as the pumping member is being rotated about an axis of rotation;

a slinger rib mounted on the strainer plate adjacent the apertures and upstream thereof so as to strike debris carried in a stream of molten metal toward the apertures, in a direction away from said inlet opening as the pumping member is being rotated; and the pump housing having feet for supporting the pump housing above the floor of a pot containing molten metal such that the bottom inlet opening faces toward the floor of the pot when receiving molten metal therein.

8. Apparatus for moving a stream of molten metal in a bath of molten metal comprising:

a pumping member adapted to be disposed in a bath of heated molten metal and to move a stream of molten metal as the pumping member is driven in a path of pumping motion;

a power device adapted to be supported above the bath of molten metal and to be actuated in a powered motion;

means for connecting the power device to the pumping member to move the pumping member in said path of pumping motion;

a pump housing having a pumping chamber and an inlet opening, the pumping member being disposed in the pump housing, the inlet opening being adapted for receiving molten metal into said pumping chamber;

the pumping member having a strainer plate in the inlet opening, having apertures for receiving molten metal into the pumping chamber as the pumping member is being rotated about an axis of rotation;

a slinger rib mounted on the strainer plate adjacent the apertures and upstream thereof so as to strike debris carried into a stream of molten metal toward the apertures, in a direction away from said inlet opening as the pumping member is being rotated; and the pumping member having pumping vanes for moving the molten metal, the vanes having vane openings therebetween greater than the strainer apertures, whereby debris passing through the inlet opening is smaller than the vane openings between the vanes.

9. A shaft comprising:

an outer tubular shield having a lower end attached to a pump housing;

an inner tubular shield telescopically disposed in said outer tubular shield and being cemented thereto;

a pumping shaft;

the inner tubular shield having a bore with a diameter greater than the diameter of the pumping shaft, and enclosing the pumping shaft so as to form a chamber therearound;

the lower end of the inner tubular shield being spaced from the lower end of the outer tubular shield to form a shoulder;

a structure disposed adjacent the lower end of the pumping shaft having a diameter greater than the diameter of the bore of the inner tubular shield but less than the diameter of the outer shield, and the structure engages the shoulder to locate the lower end of the structure with respect to the inner tubular shield; and cement disposed in the lower end of the outer shield with a socket accommodating the configuration of the structure but having a clearance therebetween to accommodate the relative thermal expansion characteristics of said structure, but permitting the structure, to be rotated in the socket to rotate the pumping shaft.

10. The apparatus as defined in claim 9, in which the lower end of the shaft has a tongue-shaped configuration.

11. The shaft as defined in claim 9, further comprising a wax that turns to gas when exposed to heat in the bath of molten metal disposed in said socket between said lower end of the shaft and said cement.

12. The apparatus as defined in claim 9, in which the shaft comprises an inner tubular graphite shield telescopically receiving the shaft;

an outer tubular graphite shield telescopically receiving the shaft and the inner tubular graphite shield; and a tubular shield telescopically receiving the shaft, the inner graphite shield and the outer graphite shield.

13. A shaft for a molten metal pump comprising:

an elongated drive element and an elongated shield assembly, the shield assembly having a monolithic closed end surrounding, and forming a space between the drive element and the shield assembly sufficient to permit thermal expansion of the drive element;

the shield assembly including:

an outer tubular shield;

an inner tubular shield telescopically disposed in the outer tubular shield;

said inner tubular shield surrounding said drive element;

an elongated graphite member disposed between said inner tubular shield and said outer tubular shield;

a drive structure supported on the lower end of the graphite member and connected to the pumping member; and cement disposed in the outer tubular shield to provide a socket accommodating a portion of said drive element extending out of said inner tubular shield, the drive element being disposed in said socket but having a clearance therebetween to accommodate the relative thermal expansion characteristics of said drive structure, but permitting the drive structure to be rotated to engage the socket wall to rotate a pumping member.

14. A shaft for a molten metal pump comprising:

an elongated drive element and an elongated shield assembly, the shield assembly being so attached to the drive element as to be rotatable therewith as a unit, the shield assembly further comprising:

an inner tubular shield having a bore with a diameter greater than the diameter of the drive element, and enclosing the drive element to form a chamber therearound sufficient to permit thermal expansion of the drive element;

an outer tubular shield having a monolithic closed lower end surrounding the drive element and the inner tubular shield;

a tongue extending from said drive element below said inner tubular shield;

at least one of said inner tubular shield and said tongue being secured to said outer shield; and said outer shield being secured to a pumping member.

15. The apparatus as defined in claim 14, in which the shield assembly is formed of a ceramic material with sufficient heat resist characteristics as to withstand the heat of the molten metal.

* * * * *